US005662433A

United States Patent [19]

Seligman

[11] Patent Number: 5,662,433

[45] Date of Patent: Sep. 2, 1997

[54] BODY CONFORMING VEST, BUOYANCY COMPENSATOR, AND BACKPACK

[75] Inventor: Scott P. Seligman, Carlsbad, Calif.

[73] Assignee: Sea Quest, Inc., Carlsbad, Calif.

[21] Appl. No.: 544,020

[22] Filed: Oct. 17, 1995

[51] Int. Cl.[6] ..... B63C 11/08; B63C 11/02

[52] U.S. Cl. ..... 405/186; 224/191; 441/88; 441/106; 405/185; 114/315

[58] Field of Search ..... 405/186; 441/88, 441/106; 224/191, 211; 114/315

[56] References Cited

U.S. PATENT DOCUMENTS

| | | | |
|---|---|---|---|
| 4,887,932 | 12/1989 | Toth | 405/186 |
| 4,913,589 | 4/1990 | Faulconer et al. | 405/186 |
| 5,020,941 | 6/1991 | Bulin et al. | 441/111 |
| 5,022,790 | 6/1991 | Stevenson | 405/186 |
| 5,363,790 | 11/1994 | Matsuoka | 114/315 |
| 5,378,084 | 1/1995 | Walters et al. | 405/186 |
| 5,451,121 | 9/1995 | Seligman | 405/186 |

*Primary Examiner*—Dennis L. Taylor
*Attorney, Agent, or Firm*—George F. Bethel; Patience K. Bethel

[57] ABSTRACT

A combination spider and buoyancy compensator having chest portions which include stretchable material to support the breasts of a diver. The buoyancy compensator is secured to the back of a spider and has forward extensions which overlap and are loosely tethered to waistband portions of the spider. The waistband portions of the spider are secured to the back portion of the spider by adjustable means for waist size adjustment.

15 Claims, 4 Drawing Sheets

BODY CONFORMING VEST, BUOYANCY COMPENSATOR, AND BACKPACK

FIELD OF THE INVENTION

This invention relates to the field of buoyancy compensators and particularly to a body conforming combination buoyancy compensator, backpack and spider having a securement, and support system that improves comfort and facilitates the use thereof.

DESCRIPTION OF THE PRIOR ART

Underwater diving preferentially requires the use of a buoyancy compensator having an inflatable bladder to provide for buoyancy trim or compensation to a diver.

Buoyancy compensators are inflated by oral power or compressed gas inflation means. During inflation, the diver is provided with increased buoyancy at greater depths to overcome the fact that a diver's buoyancy decreases as he dives deeper. This is because with greater pressure, a loss takes place regarding the lifting characteristics of the diver's buoyancy, primarily due to compression of his exposure suit and associated diving equipment.

Conversely, as the diver ascends or approaches the surface his buoyancy increases as the compression of his exposure suit and other equipment recovers. As inherent buoyancy is regained, air must be released from the buoyancy compensator to return the system to neutral buoyancy.

Thus, by increasing or decreasing the buoyancy provided by the buoyancy compensator, a diver can adjust his buoyancy to a neutral state. This provided by either adding air to the buoyancy compensator or releasing it.

In recent years, buoyancy compensators have been combined with a vest configuration commonly called a spider with means to hold a diver's backpack that supports a container or tank of pressurized breathing gas on a diver's back. The vest configuration often includes shoulder straps and a front closing waist or belt fastener for ease in putting on and securing the buoyancy compensator.

During the process of inflation and deflation, the buoyancy compensator's inflatable bladder or inner chamber changes dimensions substantially compared with its uninflated state. When inflated, the buoyancy compensator changes from its original flat configuration and becomes more spherical in shape. This change in dimension causes tightening around the diver's waist since the bladder within the buoyancy compensator must expand against the diver's body and there is no opportunity for the interior dimensions to be adjusted.

Similarly, when the buoyancy compensator is deflated, pressure against the body is decreased. This causes a loosening of the pressure around the body and waist with the possible shifting of the load provided by the tank.

Changes in buoyancy also result in increases and decreases in the load exerted by the pressurized tank or cylinder held on the backpack. Some buoyancy compensators include adjustable shoulder straps attached to the waist or belt fastener. When the waist or belt is tightened, there is a corresponding tightening of the shoulder straps. Also, an increase in the load of the tank pulls the shoulder straps tightly causing the waist to tighten and the shoulder straps to press against the chest of a diver.

Thus, changes in buoyancy can result in substantial discomfort to the diver primarily due to tightening and pressure around the waist and shoulder. This can cause considerable discomfort for women since the shoulder straps can dig into the breasts.

In addition, inflation of the buoyancy compensator affects the hydrodynamics of the buoyancy compensator. It is desirable to have the buoyancy compensator expand without causing a drag or flow restriction on a diver. This requires a body hugging or conforming profile.

Most buoyancy compensator, backpack and vest combinations are designed for a man's proportions. As a consequence it is difficult to properly fit a smaller stature such as a child or a woman both in length and around the waist. Also, current designs often have adjustable length chest straps which, when adjusted for snugness, can be a source of discomfort and chafing, especially for a woman.

It is an object of this invention to provide a novel vest or spider for support of a backpack and a buoyancy compensator which is particularly suited to a woman's anatomy and proportions.

It is a further object of the invention to provide a novel spider having novel chest portions which combine adjustable chest straps and a support framework with an elastic or stretchable fabric for distribution of weight.

It is another object of the invention to provide a buoyancy compensator having a self-adjusting tether means for maintaining the condition of hugging or holding the buoyancy compensator against a diver's body during inflation and deflation without causing discomfort to the diver.

It is a final object of the invention to provide an adjustable waistband which is independent of the suspension means holding the buoyancy compensator.

SUMMARY OF THE INVENTION

A novel combination spider, buoyancy compensator, and backpack of the invention provides an independent suspension system for the buoyancy compensator whereby the buoyancy compensator and vest are maintained close to a diver's body during inflation and deflation.

The novel vest or spider has a front chest portion which combines strap means connected to a framework made of strong fabric material which is secured to the waistband. The framework has a stretchable or elasticized fabric insert. This effectively distributes weight across the shoulders and waist of a diver. At the same time the soft stretchable fabric insert with the framework overlies the breasts of the diver.

The buoyancy compensator has a generally inverted U shape having downwardly extending lobes which include forward extensions. It is suspended from the vest or spider by attachment at the shoulders and neckline areas of the rear or back portion. In addition the buoyancy compensator is attached at various locations including the lower rear portion of the vest.

The outer surface of each of two overlapping waistbands of the vest or spider includes a ring or loop through which is threaded a band or waist strap means. One end of each strap means is attached to an inner surface of an outer front vest portion. The free ends of the band or waist strap means are threaded through an interlocking belt buckle or fastening means to form an outer belt.

The ring or loop can easily move along the strap means to lengthen the strap with inflation and shorten or contract with deflation of the buoyancy compensator. In this manner, the buoyancy compensator is loosely secured or tethered adjustably to the vest or spider.

The overlapping waistbands are adjustably secured at one end to an inner surface of the back or rear portion of the spider. A novel fastener permits tightening or loosening the waistband to provide individual fit.

This adjustment permits the buoyancy compensator to conform closely to the diver's body and yet be relatively free to expand away from the diver's body to minimize discomfort to the diver. Improved hydrodynamics and comfort are thus provided.

Novel vest or spider front chest and shoulder strap means extend from the shoulders and are attached to an open framework support having an elastic or stretchable fabric insert which is anchored to a waistband which fastens by overlapping. The chest strap means provides front length adjustment. The framework support having the elasticized or stretchable fabric or material insert overlies each breast for distribution of weight from the chest strap means to the waistband without digging into or chafing the breasts.

Tightening of the chest straps is achieved by pulling on a ring attached to one end of the strap. Loosening is easily achieved by lifting the strap buckle and pulling.

In use, after the overlapping waistbands of the vest or spider have been secured, the belt buckle means is secured overall in the manner of a belt. Preferably, the overlapping ends of the waistbands are secured with interlocking areas of hooks and brushed material such as Velcro™.

A backpack or pressurized tank holder in the form of an elongated molded hard plastic is secured to the back of the vest or spider at the top and bottom of the backpack leaving the intermediate area free.

The buoyancy compensator surrounds the backpack and the intermediate area between the lobes is utilized to loosely restrain or hold a tape or tie. The tape is attached to each downward extending portion or lobe of the buoyancy compensator and is threaded behind the backpack. In this manner, inflation of the buoyancy compensator is not unduly restricted and can, in effect, float or extend away from the spider or vest during inflation.

The entire combination or unit serves to improve the convenience and comfort of a diver. The backpack and buoyancy compensator are supported on the vest or spider so that the buoyancy compensator is held independently of the other elements and still is maintained close to the body of a diver.

At the same time, the weight of a cylinder of pressurized breathing gas is distributed across the shoulders and waist or hips for increased comfort. This combination improves the capability of a diver to function as well as increasing comfort.

BRIEF DESCRIPTION OF THE DRAWINGS

The invention will be more clearly understood by referring to the description below and the accompanying drawings in which.

DETAILED DESCRIPTION OF THE DRAWINGS

Figure 1:
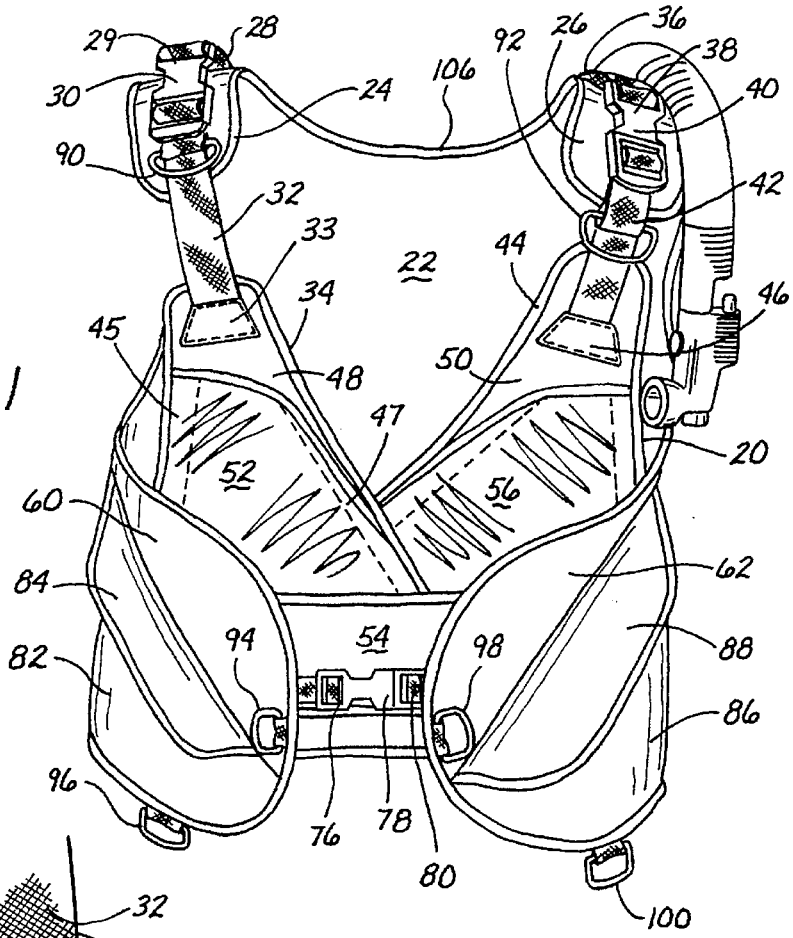
FIG 1 shows a front view of the combination buoyancy compensator, backpack and vest of the invention.

Referring now to FIG. 1 there can be seen the body conforming vest, buoyancy compensator and backpack of the invention. The vest or spider 20 includes a back or rear section 22 having shoulders 24 and 26 and neckline 106. Attached to shoulder 24 is a strap 28, the end of which is closed by one part of a fastener 29. The fastener 29 interlocks with a corresponding interlocking member 30 which is secured to a strap 32.

Strap 32 is stitched or otherwise secured to a generally triangular shaped front vest portion 34 at patch or reinforcement 33.

Similarly a strap 36 'sis secured to shoulder 26 at one end and is secured to one member 38 of a fastening member. An interlocking fastening member 40 is attached to an adjustable strap 42. Strap 42 is stitched to or otherwise secured to front chest portion 44 at patch or reinforcement 46.

The front or chest portions 34 and 44 of the vest 20 have a generally triangular shape. The upper exterior portion is formed of a strong material such as a rip-stop nylon shown at 48 for chest portion 34 and 50 for chest portion 44.

As shown in FIGS. 1, 2, 5, and 6, the upper portion 48 is stitched or otherwise secured to a substantially triangular backing material forming downwardly extending sides or legs 45 and 47. A substantially triangular framework is formed by the backing material which supports and reinforces the top, sides and bottom of front chest portion 34. Legs or peripheral triangular portions 45 and 47 are secured to waistband 54. Seam binding, tape, or narrow rips of strong fabric 49 around upper portion 48 and legs 45 and 47 provides further reinforcement.

Figure 2:
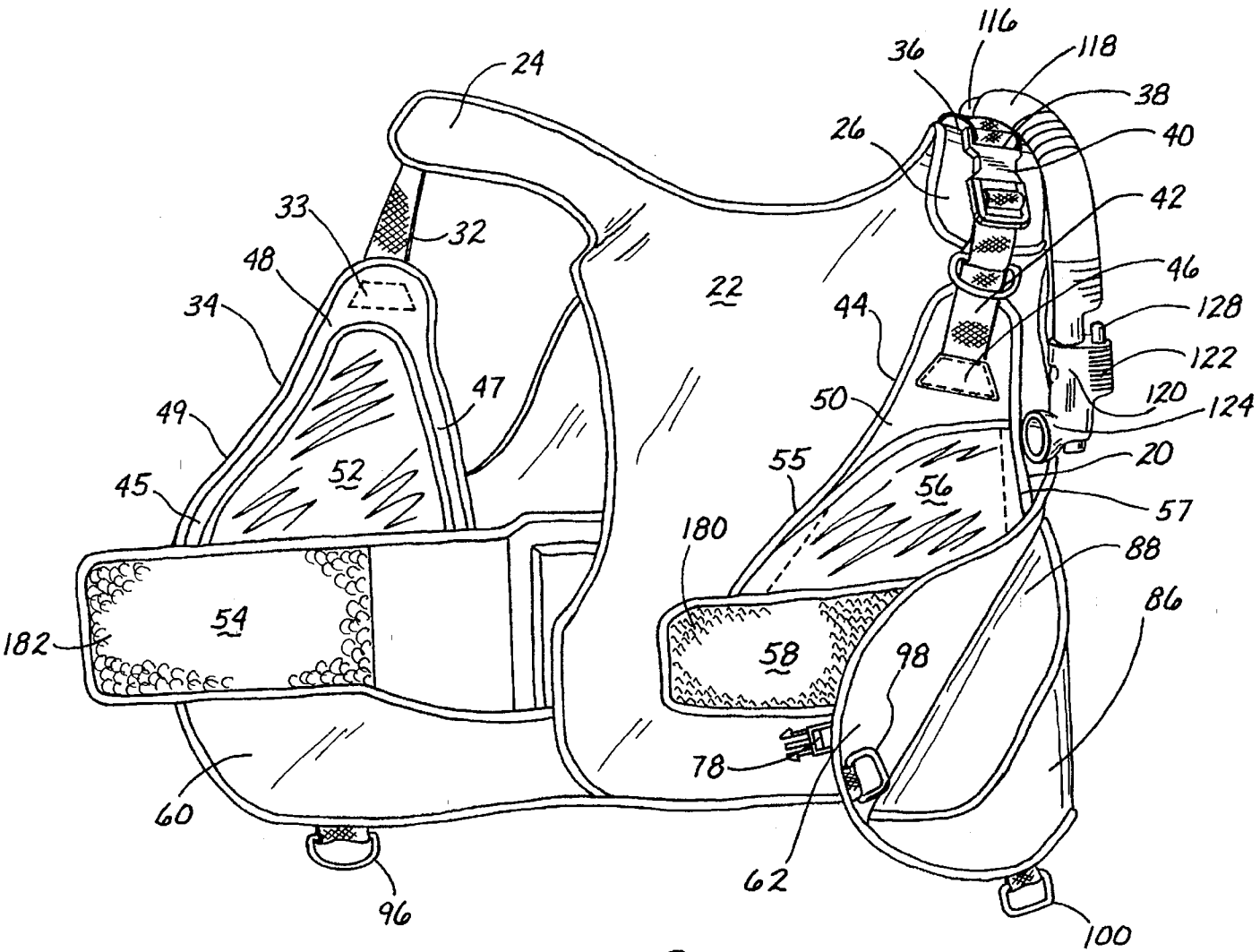
FIG 2 shows a perspective view of the spider or vest of the invention with a portion of the inside detailed.
Figure 5:
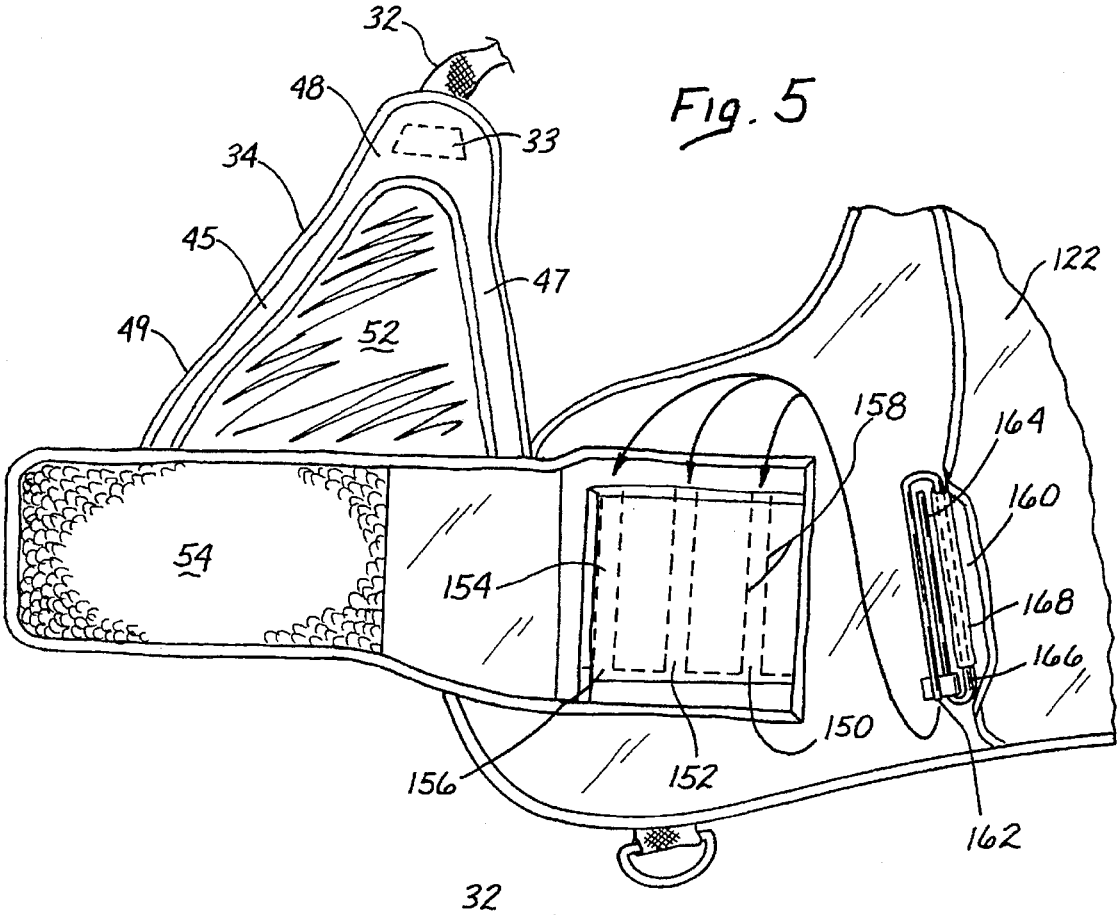
FIG. 5 shows a detailed view of the adjustable securement of the waistband to the rear or back of the spider or vest with the two portions seperated.
Figure 6:
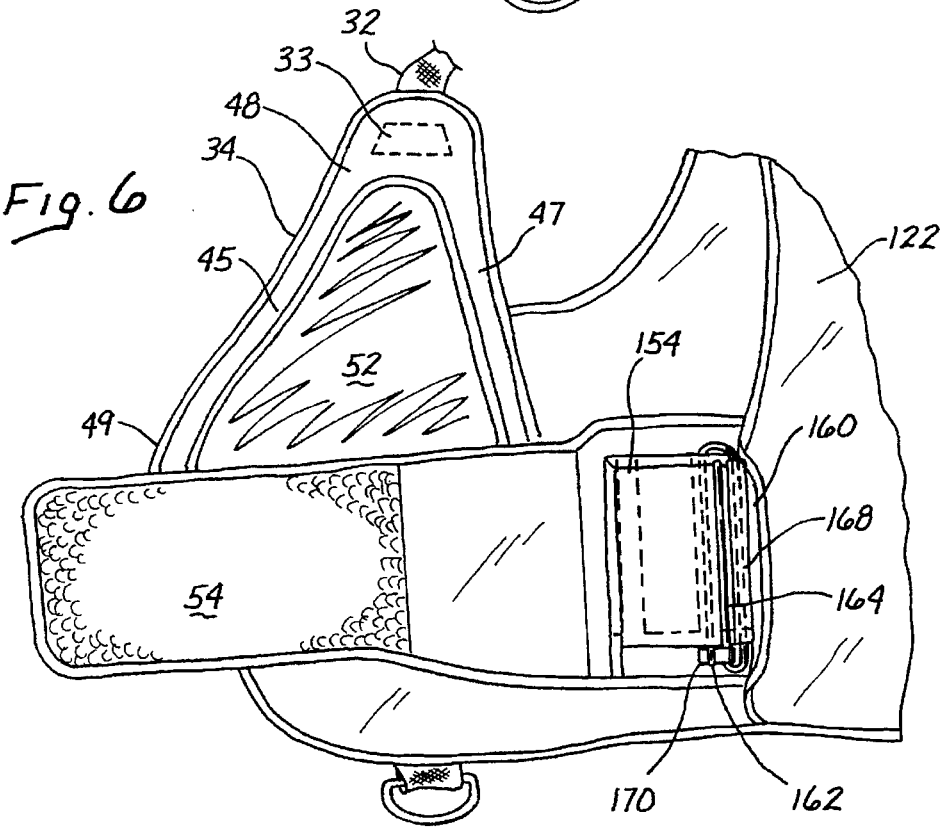
FIG. 6 shows the interconnecting parts of the adjustable securement fastener in the connected position.

Chest portion 44 of the vest or spider 20 includes upper portion 50 which is stitched or otherwise secured to a substantially triangular shaped backing material forming downwardly extending sides or legs or peripheral triangular portions 55 and 57. The framework formed by the backing material is augmented by seam binding, tape or narrow strips of strong fabric 59 to provide additional reinforcement. Only the underside view of chest portion 34 is shown in FIGS. 2, 5, and 6. However, chest portion 44 has the same construction.

The backing material forming legs or peripheral triangular portions 45 and 47, and legs or peripheral triangular portions 55 and 57 is preferably soft and strong such as a brushed nylon or polyester, although other materials can be used.

The body or interior of the triangular chest portion 34 is comprised of an elasticized or stretchable fabric or material 52 such as Lycra™. As viewed from the exterior, the material 52 is stitched to and covers the sides or legs 45 and 47. The base of the triangular front or chest portion 34 is received into a waist band 54.

Similarly, the chest portion 44 includes an elasticized or stretchable fabric or material 56 which is received into a waistband portion 58 at its base. The material 56 is stitched to and covers the sides or legs 55 and 57.

The substantially triangular shape of the front vest portions 34 and 44 together with the chest straps 32 and 42 and the waistbands 54 and 58 form a support or sling which distributes weight carried by the backpack over the shoulders, waist and hips of a diver. This prevents discomfort from straps and buckles digging into breasts or tender skin which has been a problem with prior art spiders or vests.

In addition, the inclusion of the elasticized or stretchable fabric or material provides additional support and comfort to a diver, particularly to a woman diver.

The use of the elasticized or stretchable fabric or material is a preferred embodiment of the invention. However, there will be a distribution of weight without its use.

The back 22 of the vest or spider 20 has attached a buoyancy compensator 104 which has a generally inverted U shape to permit surrounding a backpack 126.

The buoyancy compensator includes downwardly extending lobes 200 and 202 which include lower forward extensions 60 and 62. Forward extensions 60 and 62 overlap the waistbands 54 and 58 on the front of the vest or spider 20. The overlapping portions or extensions 60 and 62 each contain a novel tether strap as detailed in FIG. 3.

Figure 3:
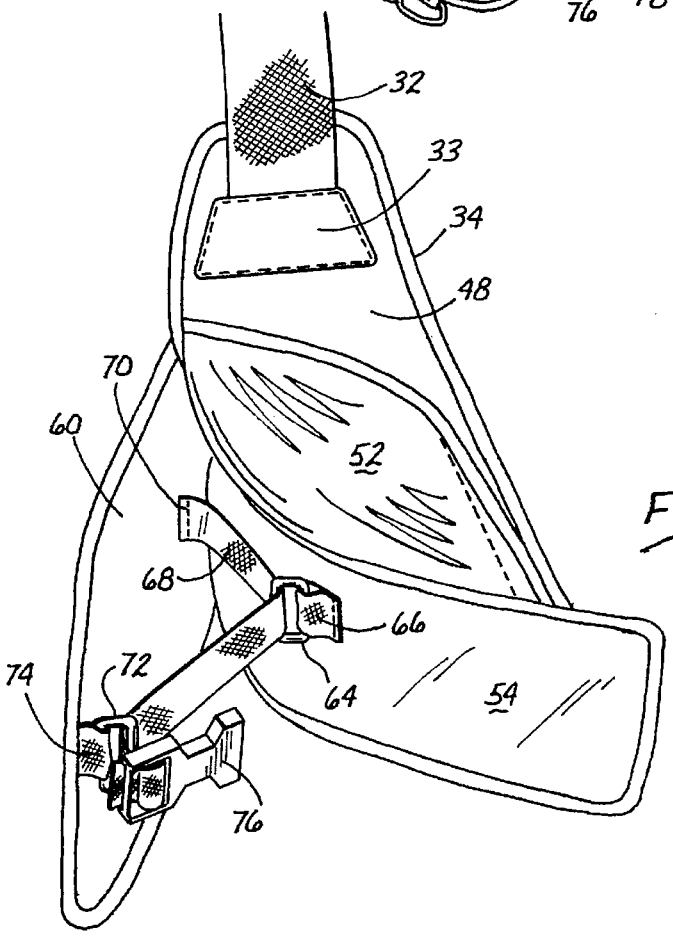
FIG. 3 shows a perspective view of the tether strap for loosely confining the buoyancy compensator to the waistband of the vest.

As shown in FIG. 3 the waistband 54 has a ring 64 which is secured to the waistband 54 by means of a loop of material 66.

Inserted or threaded through the ring 64 is a strap 68 having one end secured to the forward extension 60 by means of stitching as shown at 70.

Another ring 72 is attached to the forward extension 60 by means of a loop of material 74 which is secured to the inner portion of forward extension 60.

The free end of strap 68 after being threaded through ring 64 is passed through ring 72 and is secured to one member 76 of an interlocking fastener.

The other member 78 of the interlocking fastener is attached in a similar fashion to a strap 80 in the manner described above.

While the strap 68 is shown as attached to forward extension 60 in the manner described, strap 68 can be attached in the same fashion to the waistband 54. Similarly, additional rings such as ring 64 and ring 74 can also be used and the location can be adjusted as desired. The strap 68 is intended to loosely confine the buoyancy compensator 104 against the body of a diver during inflation and deflation.

The forward extension 60 includes an exterior pocket 82 having a closing flap 84. Similarly extension 62 includes an exterior pocket 86 which is closed by means of a flap 88.

The closure of the flap 88 onto the pocket 86 is preferably by means of areas of hooks and brushed material such as Velcro™ which interlock with one another.

The novel combination buoyancy compensator, backpack and vest 20 is also provided with a plurality of rings such as ring go attached to strap 32 and ring 92 attached to strap 42.

On the extension 60 can be found a ring 94 and a ring 96. Also a ring 98 and 100 are attached to extension 62. These rings are provided for purposes of attaching various diving accessories.

Figure 4:
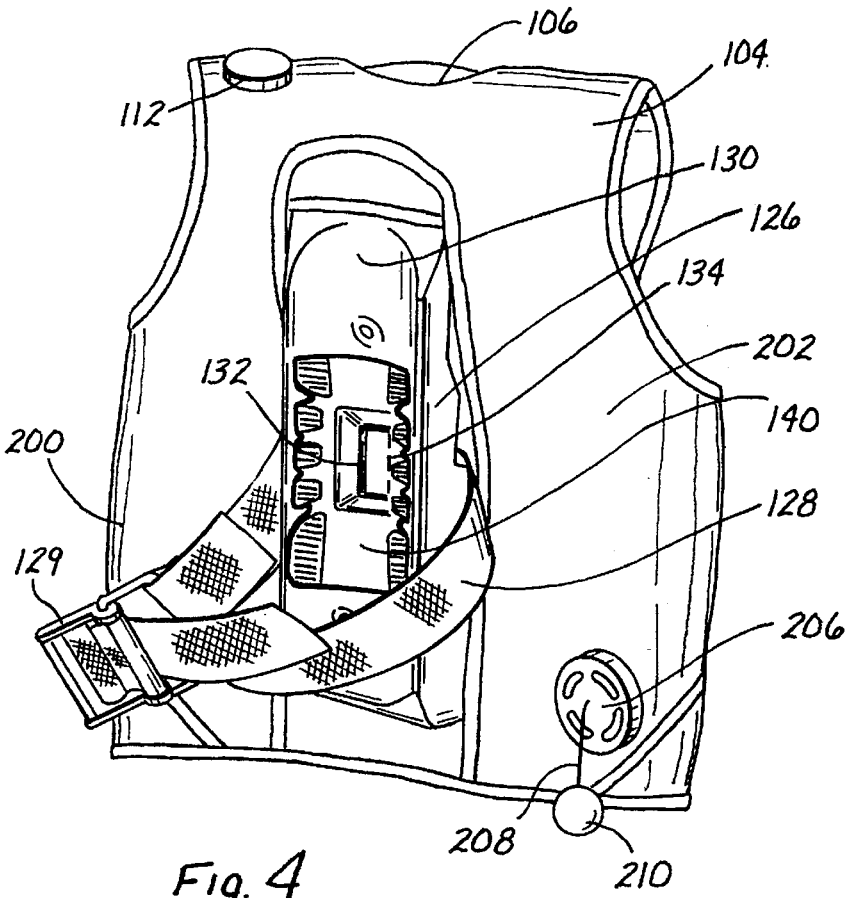
FIG. 4 shows a perspective rear view of the buoyancy compensator and vest of the invention.
Figure 7:
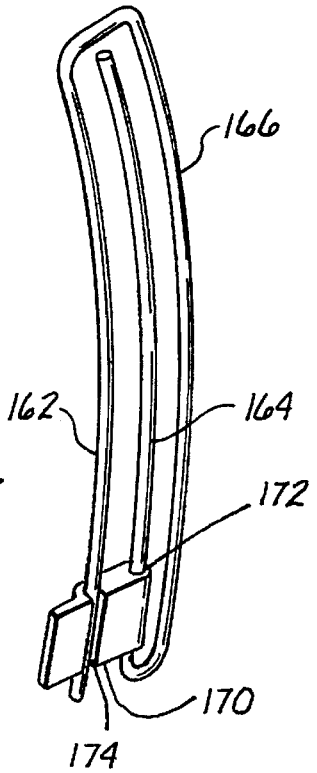
FIG. 7 shows the loop and clip forming a portion of the adjustable fastener of FIGS. 5 and 6.
Figure 8:
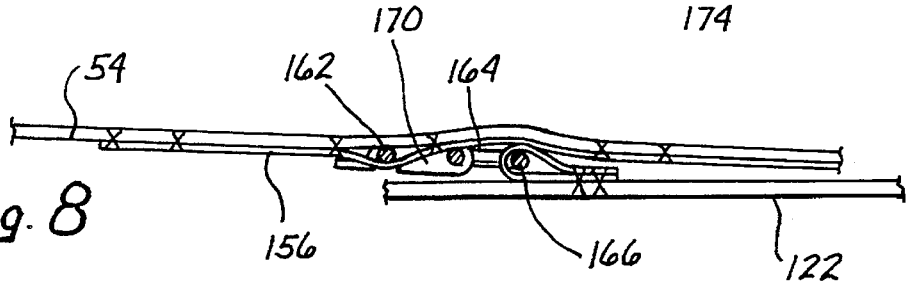
FIG. 8 shows a bottom plan view of the adjustable securement fastener shown in FIG. 6.

Referring now to FIG. 4 there can be seen a rear view of the vest or spider 20 of the invention. In particular, the buoyancy compensator 104 is shown. The buoyancy compensator 104 is attached to the rear or back section 22 of spider or vest 20 at the neck 106 and shoulders 24 and 26 as by stitching, heat sealing or other method.

The bottom of the buoyancy compensator 104 is also secured to the bottom area of the back 22 of vest or spider 20.

As shown in FIGS. 1 and 4, an opening 112 in the shoulder portion of the buoyancy compensator 104 enables emplacement of an over-pressure release valve 116 which is connected to an inflator tube 118. The end of the inflator tube 118 includes a high-pressure inflation valve 120 and an oral inflator 122 having a mouthpiece 124.

The high-pressure inflation valve 120 is in fluid communication with a high-pressure line from a tank or cylinder not shown. The valve 120 operates by means of a valve button 128.

The overpressure valve 116 can be released by pulling the inflator tube 118. The inflator tube 118 includes a wire cable, not shown, which when pulled opens the release valve 116.

A release valve 206 having a cord 208 attached to a ball handle 210 is disposed within the rear portion of the buoyancy compensator 104. Pulling on the ball handle 210 opens the release valve 206.

A backpack 126 shown in FIG. 4 is formed preferably of a hard plastic into an inverted T-shape. The backpack 126 is secured usually at the top and bottom by stitching, riveting, and/or bolting to the back or rear portion 22 of spider or vest 20.

The center area 130 of backpack 126 is contoured to the curved surface of a pressurized breathing gas cylinder or tank not shown. A strap 128 having a buckle 129 is threaded from the rear through central openings 132 and 134 of backpack 126 for securement around a pressurized breathing gas cylinder, not shown.

The central area 130 of the backpack 126 is provided with a non-slip surface 140 to assist in gripping the pressurized breathing gas cylinder.

The buoyancy compensator 104 which overlies the rear or back portion 22 of the spider, is formed of two sealed layers of gas impermeable material which is inflatable. The shape is irregular having a top portion with downward lobes 200 and 202 which surround the backpack 126. A tape or tie not shown is attached to each downward lobe 200 and 202 and passed behind the backpack 126 to loosely restrain each downward portion or lobe 200 and 202 of the buoyancy compensator.

The waistbands 54 and 58 are adjustably secured to the back or rear portion 22 of spider or vest 20 as shown in FIGS. 2, 5, 6, 7, and 8.

As shown in FIG. 5, an inner surface of waistband 54 is provided with a series of longitudinal pockets or slots 150, 152, and 154. These slots 150, 152, and 154 are formed by means of a layer of material 156 having stitching 158 thereon to secure the material 156 to the waistband 54 in such a way as to leave the slots 150, 152, and 154 open at the top and bottom.

An inner surface 160 of back 22 of spider 20 is provided with a pin 162 formed generally into an inwardly turned, rectangular piece. The pin 160 contains a straight outer end extension 162 and a straight inner end extension 164 and an outer straight extension 166. The outer extension 166 is held by means of a stitched down piece of material 168 which is secured to the underside 160 of back or rear section 122 as shown in FIG. 5.

The outer end piece 162 is received into slot 150, 152, or 154 in waistband 54. As shown in FIG. 6, the pin end extension 162 is received into slot 152. It is held in place by means of a clip 170.

Clip 170 includes a through-hole 172 which receives inner end extension 164 and a slot 174 which snaps over an end portion of extension 162 which extends beyond the end of slot 152 as shown in FIG. 6.

In this fashion, the waistband 54 and waistband 58 can be made smaller or larger depending on which slot 150, 152, or 154 is utilized.

The waistbands 54 and 58 are provided with interlocking hooks and brushed areas 180 and 182 in the form of a Velcro™-like material for adjustable overlapping securement. However, other securement means can be used in place of the hooks and brushed material, including among others buckles, ties, snaps, bayonet fittings and the like.

All of the materials to be used in making the spider or vest in combination with the buoyancy compensator and backpack should be impervious or resistant to water, sunlight and especially to salt water. Plastic materials are preferred when possible for buckles, clips, backpack, valves and the like. Certain metals such as stainless steel and various metal alloys can also be used.

The exterior material of the vest or spider as well as the buoyancy compensator is preferably made of ripstop type nylon material or other strong material such as nylon or polyester or other polymer material.

Various modifications of the invention are contemplated and can be resorted to without departing from the spirit and scope of the invention as defined by the following claims.

I claim:

1. A combination spider and buoyancy compensator comprising:

a spider comprising two shoulder portions, two chest portions and a back portion extending from said two shoulder portions, and two waistband portions which extend from said back portion for fastening around a diver's waist;

said two chest portions each comprise a substantially triangular framework of fabric having a top formed with downwardly extending legs and a bottom, each framework defining a substantially triangular opening adapted to surround one breast of a diver;

said top of said triangular framework is attached to said two shoulder portions and said bottom is attached to said two waistband portions;

stretchable material disposed within said framework;

a backpack attached to said back portion of said spider for holding a cylinder of pressurized breathing gas; and, a buoyancy compensator disposed at least partially around said backpack and at least partially secured to said spider.

2. A combination spider and buoyancy compensator according to claim 1 further comprising:

strap means attached to said shoulder portions; and, said top portion of said triangular framework attached to said strap means.

3. A combination spider and buoyancy compensator according to claim 1 wherein:

said back portion and said waistband portions are connected by adjustable means.

4. A combination spider and buoyancy compensator according to claim 3 wherein:

said adjustable means for connecting said back portion and said waistband portions comprises:

a fastener having interlocking parts;

at least one first interlocking part of said fastener attached to said back portion; and, at least one second interlocking part of said fastener attached to at least one of said waistband portions for interlocking with said at least one first interlocking part of said fastener.

5. A combination spider and buoyancy compensator comprising:

a spider comprising two shoulder portions, two chest portions and a back portion extending from said two shoulder portions, and two waistband portions which extend from said back portion for fastening around a diver's waist;

said chest portions each comprise a substantially triangular framework of fabric having a top formed with downwardly extending legs and a bottom, each framework defining a substantially triangular opening adapted to surround one breast of a diver;

said top of said triangular framework is attached to said shoulder portions and said bottom is attached to said waistband portions;

a buoyancy compensator attached to said spider;

a backpack attached to said back portion of said spider for holding a cylinder of pressurized breathing gas;

said back portion and said waistband portions are connected by adjustable means comprising:

at least one narrow pocket formed within at least one of said wasitband portions and said back portion;

at least one fastener secured to at least one of said waistband portions and said back portion and having at least one pin for insertion within said at least one narrow pocket; and, means secured to said pin to resist removal of said pin from said at least one narrow pocket.

6. A combination spider and buoyancy compensator according to claim 5 wherein:

each said waistband portion contains at least one narrow pocket;

said back portion has two fasteners secured thereto, each fastener having a pin for insertion into said at least one narrow pocket on each of said waistband portions; and, a clip secured to said pin to resist removal of said pin from said at least one narrow pocket.

7. A combination spider and buoyancy compensator according to claim 1 wherein:

said buoyancy compensator has two extensions which extend forwardly over at least a portion of said waistband portions;

at least one loop is attached to at least one of said waistband portions and of said extensions;

at least one strap is held by said at least one loop and having at least one end secured to at least one of said extensions of said buoyancy compensator and said waistband portions.

8. A combination spider and buoyancy compensator comprising:

a spider comprising two shoulder portions, two chest portions and a back portion which extends from said two shoulder portions, and two waistband portions which extend from said back portion for fastening around a diver's waist;

said chest portions each comprise a substantially triangular framework of fabric having a top formed with downwardly extending legs and a bottom, each framework defining a substantially triangular opening adapted to surround one breast of a diver;

said top of said triangular framework is attached to said two shoulder portions and said bottom is attached to said two waistband portions;

stretchable material disposed within said framework;

a buoyancy compensator which is attached to said spider;

a backpack attached to said back portion of said spider for holding a cylinder of pressurized breathing gas;

said buoyancy compensator has two extensions which extend forwardly over at least a portion of said waistband portions;

at least one loop is attached to at least one of said waistband portions and of said extensions;

at least one strap is held by said at least one loop and has at least one end secured to at least one of said extensions of said buoyancy compensator and said waistband portions;

each of said extensions has at least one strap held by said at least one loop; and, said at least one strap having at least one end secured to at least one of said extensions of said buoyancy compensator and of said waistband portions;

said at least one strap has a free end; and, a fastener having two interlocking parts, each said interlocking part secured to a free end of said at least one strap for fastening together.

9. A combination spider and buoyancy compensator according to claim 1 wherein:

said side portions of said buoyancy compensator have forward extensions which at least partially overlap said waistband portions; and, means attached to said buoyancy compensator forward extensions and said waistband portions to loosely secure said buoyancy compensator forward extensions to said waistband portions.

10. A combination according to claim 9 wherein:

said means attached to said buoyancy compensator forward extensions and said waistband portions comprise:

at least one loop attached to at least one of said waistband portions and of said extensions; and, at least one strap held by said at least one loop and having at least one end secured to at least one of said extensions of said buoyancy compensator and said waistband portions.

11. A combination according to claim 10 further comprising:

a fastener having two interlocking parts;

at least one strap having two ends, one end being secured to one of said buoyancy compensator forward extensions and the other end of said strap being secured to one interlocking part of said fastener;

at least one strap having two ends, one end being secured to the other one of said buoyancy compensator forward extensions and the other end of said strap being secured to the other interlocking part of said fastener for fastening together over said waistband portions; and, each of said at least one strap being held by said at least one loop.

12. A combination according to claim 10 wherein:

said back portion and said waistband portions are secured by adjustable means.

13. A combination according to claim 12 wherein:

said adjustable means for securing said back portion and said waistband portions comprise:

a fastener having interlocking parts;

at least one first interlocking part of said fastener attached to said back portion; and, at least one second interlocking part of said fastener attached to at least one of said waistband portions for interlocking with said at least one first interlocking part of said fastener.

14. A combination spider and buoyancy compensator according to claim 13 wherein:

at least one narrow pocket is formed within at least one of said waistband portions and said back portion;

at least one fastener is secured to at least one of said back portion and said waistband portions and having at least one pin for insertion within said at least one narrow pocket; and, locking means secured to said pin to resist removal of said pin from said at least one narrow pocket.

15. A combination spider and buoyancy compensator comprising:

a spider comprising two shoulder portions, two chest portions and a back portion extending from said two shoulder portions, and two waistband portions which extend from said back portion for fastening around a diver's waist;

said two chest portions each includes two diverging straps extending from each of said two shoulder portions forming a framework with a bottom extending between said two diverging straps, each framework defining an opening adapted to surround one breast of a diver;

said bottom of said framework is attached to said two waistband portions;

a backpack attached to said back portion of said spider for holding a cylinder of pressurized breathing gas; and, a buoyancy compensator disposed at least partially around said backpack and at least partially secured to said spider.

* * * * *